US008262082B2

(12) United States Patent
Lee

(10) Patent No.: US 8,262,082 B2
(45) Date of Patent: Sep. 11, 2012

(54) MEDIUM SUPPLYING UNIT AND IMAGE FORMING APPARATUS HAVING THE SAME

(75) Inventor: Jin-Soo Lee, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 827 days.

(21) Appl. No.: 12/260,382

(22) Filed: Oct. 29, 2008

(65) Prior Publication Data

US 2009/0153890 A1 Jun. 18, 2009

(30) Foreign Application Priority Data

Dec. 18, 2007 (KR) ..... 10-2007-0133528

(51) Int. Cl.
*B65H 1/08* (2006.01)
*B65H 3/06* (2006.01)

(52) U.S. Cl. ..... 271/127; 271/119; 271/118; 271/157; 271/117

(58) Field of Classification Search ..... 271/119, 271/127, 117, 118, 157
See application file for complete search history.

(56) References Cited

U.S. PATENT DOCUMENTS 6,899,326 B2 * 5/2005 Kawakami et al. ..... 271/114
7,364,152 B2 * 4/2008 Suwa ..... 271/118
7,481,422 B2 * 1/2009 Lim ..... 271/118
7,481,423 B2 * 1/2009 Lim et al. ..... 271/118
7,510,180 B2 * 3/2009 Jang et al. ..... 271/127
7,699,306 B2 * 4/2010 Lim et al. ..... 271/127
7,712,736 B2 * 5/2010 Chinzei ..... 271/157
2003/0230844 A1 * 12/2003 Shimoyama ..... 271/127

FOREIGN PATENT DOCUMENTS

KR 20-1999-0029304 7/1999
KR 10-2000-0044280 7/2000

OTHER PUBLICATIONS

English language abstract of KR 20-1999-0029304, published Jul. 15, 1999.
English language abstract of KR 10-2000-0044280, published Jul. 15, 2000.

* cited by examiner

*Primary Examiner* — Luis A Gonzalez
(74) *Attorney, Agent, or Firm* — Stanzione & Kim, LLP

(57) ABSTRACT

A medium supplying unit of an image forming apparatus includes: a cassette frame; a loading plate which is movably coupled to the cassette frame, and which supports a printing medium thereon; a pickup roller which picks up the printing medium from the loading plate; and a loading plate moving unit which causes the loading plate between a knock up state in which the loading plate located to allow the printing medium can be picked up by the pickup roller and a knock down state in which the loading plate is separated from the pickup roller, the loading plate moving unit causing the loading plate to move during when the loading plate is in the knock down state so as to reduce the occurrence of multiple sheets of printing media being picked up and supplied.

22 Claims, 8 Drawing Sheets

MEDIUM SUPPLYING UNIT AND IMAGE FORMING APPARATUS HAVING THE SAME

CROSS-REFERENCE TO RELATED APPLICATION

This application claims priority from Korean Patent Application No. 10-2007-0133528, filed on Dec. 18, 2007 in the Korean Intellectual Property Office, the disclosure of which is incorporated herein by reference in its entirety.

BACKGROUND OF THE INVENTION

1. Field of the Invention

The present invention relates to a medium supplying unit and an image forming apparatus having the same, and more particularly, to a medium supplying unit and an image forming apparatus having the same capable of reducing the occurrences of concurrent pick up and/or supply of multiple printing media.

2. Description of the Related Art

An image forming apparatus performs a printing operation to form a visible image on a printing medium by means of a developer or an ink based on an image data. To this end, the image forming apparatus includes a medium supplying unit holding and supplying the printing during the printing operation.

A conventional medium supplying unit typically includes a loading plate on which a plurality of printing media are stacked, and a pickup roller for picking up the printing medium an individual sheet at a time. That is, when the printing operation starts, the pickup roller rotates, and picks up and supplies a sheet of printing medium from the top of the stack of the printing media.

However, due to various possible reasons, including, for example, static charges in the sheets of printing media, more than one sheet may concurrently be picked up or otherwise supplied by the pickup roller, which may result in the printing medium being jammed inside the image forming apparatus causing the apparatus malfunction or to be inoperable.

There are various methods heretofore suggested for preventing the problem of multi-sheet supply, and among these, a medium supplying unit employing a cam that rotates in an interlocked manner with the pickup roller, and that by so rotating selectively separates the loading plate from the pick up roller. In these type of medium supplying units, after a printing medium at the top of the stack has been picked up by the pickup roller, the cam rotates into position to push the loading plate away from the pickup roller.

However, because the multi-sheet supply is typically caused by the contact or the attractions between the sheet on the top of the stack with those few sheets immediately below, the movement of the loading plate away from the pick up roller as practiced in the legacy medium supplying unit in-and-of-itself may not be sufficient in reducing the occurrences of the multi-sheet supply.

SUMMARY OF THE INVENTION

Accordingly, it is an aspect of the present invention to provide a medium supplying unit and an image forming apparatus employing the same that are capable of reducing the occurrences of multiple sheets of printing media being supplied concurrently.

Additional aspects of the present invention will be set forth in part in the description which follows and, in part, will be obvious from the description, or may be learned by practice of the embodiments.

The foregoing and/or other aspects of the present invention can be achieved by providing a printing medium supplying unit of an image forming apparatus, which comprises a medium supplying unit frame; a loading plate movably coupled to the cassette frame, the loading plate including a surface for supporting a plurality of printing media thereon, the loading plate being movable between a knock up state and a knock down state; a pickup roller disposed at a location in relation to the loading plate such that, when the loading plate is in the knock up state, the pick up roller is capable of contacting at least one of the plurality of printing media supported on the surface of the loading plate to pick up the at least one of the plurality of printing media, and, when the loading plate is in the knock down state, the pickup roller is spaced apart from the plurality of printing media; and a loading plate moving unit arranged to rotate in interlocked manner with the pickup roller, the loading plate moving unit being configured to cooperate with a portion of the loading plate to impart a movement of the loading plate when the loading plate is in the knock down state.

The loading plate moving unit may include a cam member coupled to a shaft, to which the pickup roller is coupled, so that the cam member and the pickup roller being rotatable about an axis along the shaft, the cam member including a contact portion that is capable of being in pressing contact with the portion of the loading plate.

The contact portion of the cam member may comprise a prominence and depression section that includes at least one prominence portion configured to cooperate with the portion of the loading plate so that the loading plate is spaced apart from the shaft by a first distance, the prominence and depression section further including at least one depression portion configured to cooperate with the portion of the loading plate so that the loading plate is spaced apart from the shaft by a second distance, the movement of the loading plate corresponding to a difference between the first distance and the second distance.

The at least one prominence portion may further comprise a plurality of prominence portions, the at least one depression portion comprises a plurality of depression portions, the plurality of prominence portions and the plurality of depression portions disposed in alternating manner with respect to each other, the portion of the loading plate being in contact sequentially with the plurality of prominence portions and the plurality of depression portions so that the movement of the loading plate occurs repeatedly.

The cam member may further comprise a flattened section arranged to comes inc pressing contact with the portion of the loading plate prior to the portion of loading plate coming in contact with the prominence and depression section to thereby placing the loading plate in the knock down state before the prominence and depression section imparts the movement of the loading plate.

The portion of the loading plate may comprise a bearing roller disposed on the loading plate to contact with the cam member.

Another aspects of the present invention can be achieved by providing an image forming apparatus, which may comprise a main body frame defining an outer appearance of the image forming apparatus; an image forming unit which forms an image on a printing medium; and a printing medium supplying unit for supplying the printing medium to the image forming unit, the printing medium supplying unit may comprise: a loading plate including a surface for supporting a plurality of printing media thereon, the loading plate being movable between a knock up state and a knock down state; a pickup roller disposed at a location in relation to the loading plate such that, when the loading plate is in the knock up state, the pick up roller is capable of contacting at least one of the plurality of printing media supported on the surface of the loading plate to pick up the at least one of the plurality of printing media, and, when the loading plate is in the knock down state, the pickup roller is spaced apart from the plurality of printing media; and a loading plate moving unit arranged to rotate in interlocked manner with the pickup roller, the loading plate moving unit being configured to cooperate with a portion of the loading plate to impart a movement of the loading plate when the loading plate is in the knock down state.

Yet another aspects of the present invention can be achieved by providing an printing medium supplying unit of an image forming apparatus, which may comprise a medium supplying unit frame; a loading plate movably coupled to the cassette frame, the loading plate including a surface for supporting a plurality of printing media thereon, the loading plate being movable between a knock up state and a knock down state, the loading plate being positioned to allow a pick up roller of the image forming apparatus to contact and to pick up at least one of the plurality of printing media supported on the surface of the loading plate, and the loading plate being positioned is in the knock down state so that the pickup roller is spaced apart from the plurality of printing media; and a loading plate moving unit arranged configured to impart a movement of the loading plate when the loading plate is in the knock down state.

The loading plate moving unit may comprise a cam member disposed on the loading plate, the cam member including a contact portion that is capable of being in pressing contact with a bearing roller coupled to a shaft, to which the pickup roller is coupled.

The contact portion of the cam member may comprise a prominence and depression section that includes at least one prominence portion configured to cooperate with the bearing roller so that the loading plate is spaced apart from the shaft by a first distance, the prominence and depression section further including at least one depression portion configured to cooperate with the portion of the loading plate so that the loading plate is spaced apart from the shaft by a second distance, the movement of the loading plate corresponding to a difference between the first distance and the second distance.

The at least one prominence portion comprises a plurality of prominence portions, the at least one depression portion comprises a plurality of depression portions, the plurality of prominence portions and the plurality of depression portions disposed in alternating manner with respect to each other, the portion of the bearing roller being in contact sequentially with the plurality of prominence portions and the plurality of depression portions so that the movement of the loading plate occurs repeatedly.

The cam member may further comprise a flattened section arranged to comes inc pressing contact with the bearing roller prior to the bearing roller coming in contact with the prominence and depression section to thereby placing the loading plate in the knock down state before the prominence and depression section imparts the movement of the loading plate.

The printing medium supplying unit may further comprise: an elastic member disposed between the medium supplying unit frame and the loading plate, the elastic member imparting an elastic bias on the loading plate so that the loading plate is biased to be in the knock up state.

BRIEF DESCRIPTION OF THE DRAWINGS

These and/or other aspects of the present invention will become apparent and more readily appreciated from the following description of the embodiments, taken in conjunction with the accompanying drawings, in which.

DETAILED DESCRIPTION OF SEVERAL EMBODIMENTS OF THE INVENTION

Figure 1:
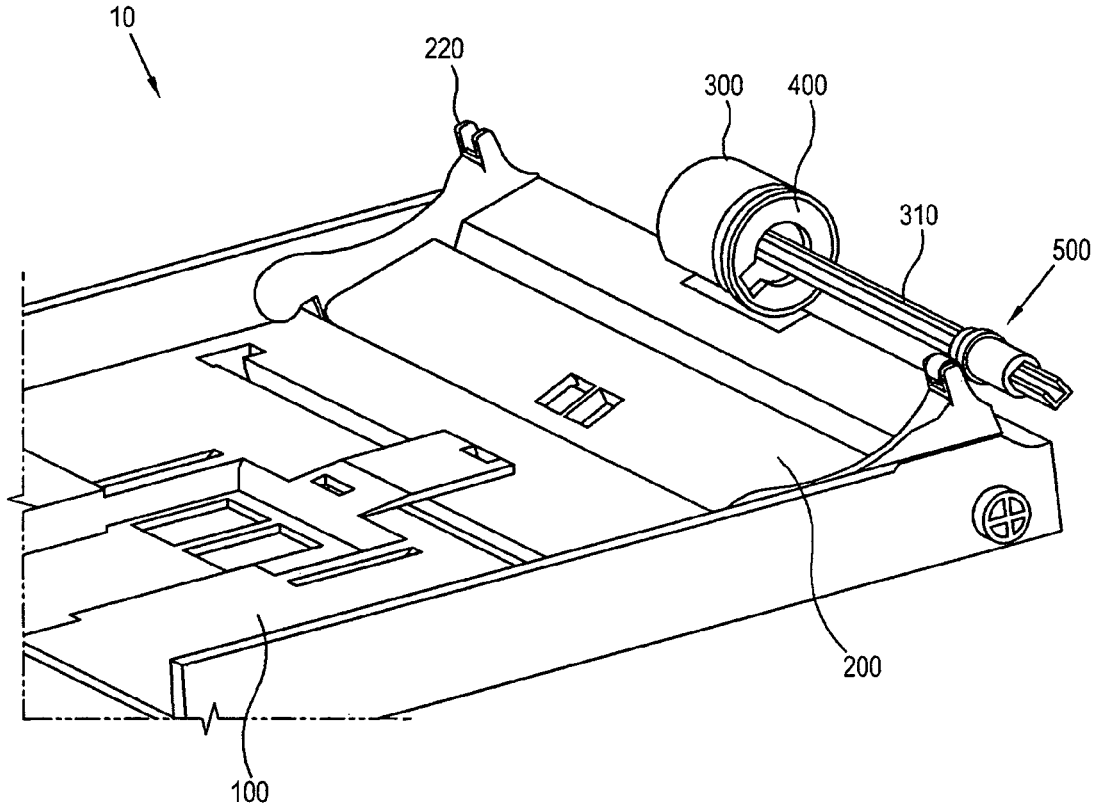
FIG. 1 is a perspective view illustrating a medium supplying unit of an image forming apparatus according to an embodiment of the present invention.

Reference will now be made in detail to the embodiments of the present invention, examples of which are illustrated in the accompanying drawings, wherein like reference numerals refer to like elements throughout.

Figure 2:
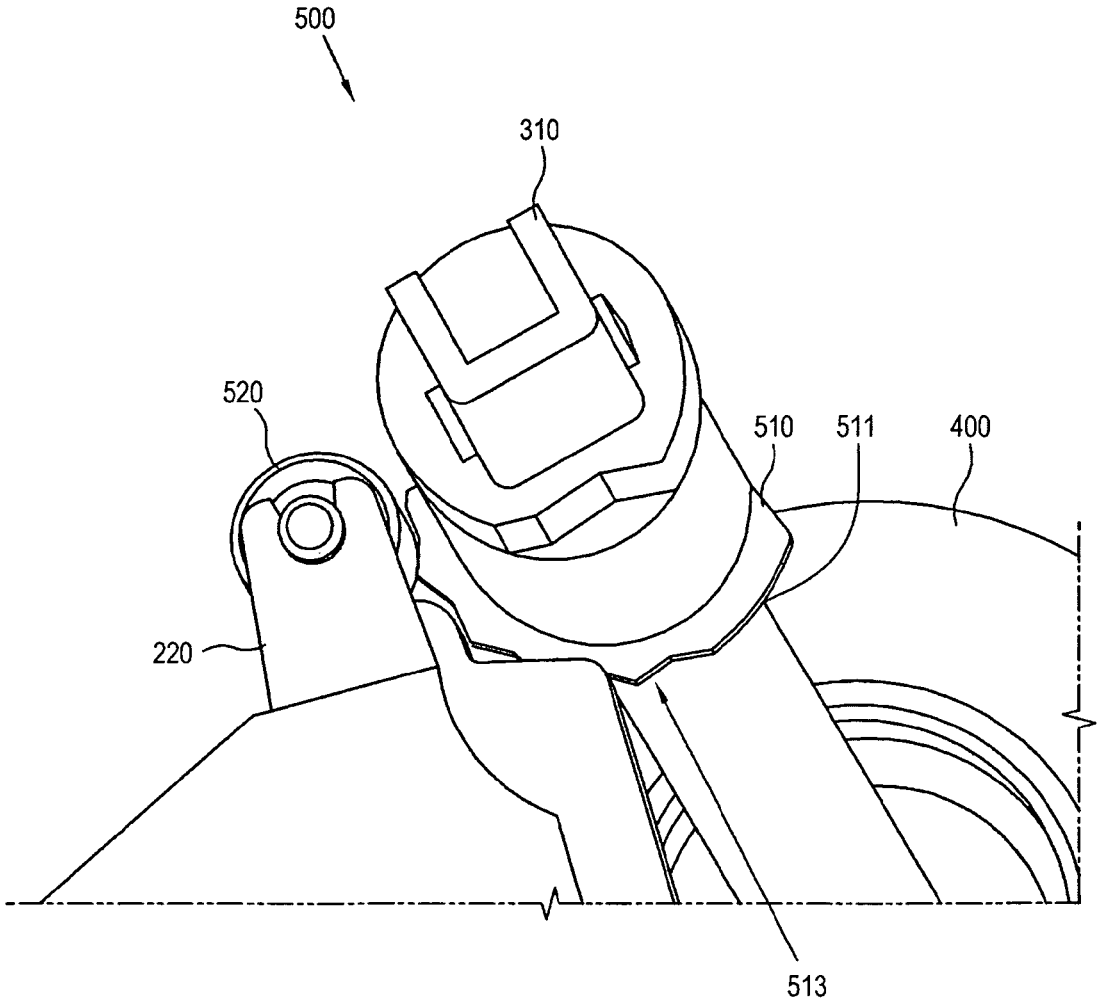
FIG. 2 is a perspective view illustrating details of the relevant portions of the medium supplying unit in FIG. 1 viewed from a different position.

As shown in FIGS. 1 and 2, the medium supplying unit 10 of the image forming apparatus according to the embodiment includes a cassette frame 100 mounted to a main body frame (not shown) of the image forming apparatus, a loading plate 200 moveably coupled to the cassette frame 100, and on which are loaded the printing medium, a pickup roller 300 for picking up the printing medium loaded on the loading plate 200, and a loading plate moving unit 500 moving the loading plate 200 away from the pickup roller 300 after a printing medium has been picked up.

While in this embodiment, the loading plate moving unit 500 shown as being disposed to only one side of the loading plate 200, but any number of the loading plate moving unit 500 may be provided, including preferably on both sides of the loading plate 200 so that the loading plate 200 can move symmetrically.

As shown in FIG. 1, the cassette frame 100 may have a rectangular planar shape, the upper surface of which is left open so that printing media can be loaded therethrough. The cassette frame 100 may be detachably installed in the main body frame of the image forming apparatus.

The loading plate 200 is disposed in the cassette frame 100, and provides a surface onto which the printing medium can be loaded. A hinged or pivoting connection may be provided on one end such that the loading plate 200 may rotate about the connection to allow the other free end of the loading plate 200 to move up and down in the cassette frame 100. An elastic member 210 (shown in FIGS. 3-7) is interposed between the bottom surface of the loading plate 200 and the cassette frame 100 to upwardly bias the loading plate 200 toward the pickup roller 300. The elastic member 210 may have various configurations as long as it can provide the elastic bias to the loading plate 200, and, for example, may include a coil or compression spring.

The loading plate 200 is pressed toward the pickup roller 300 by means of the elastic member 210, and is. The state, in which the loading plate 200 is positioned so that the printing medium at the top of the stack of media placed on the loading plate 200 comes into contact with, and thereby, can be picked up by the pickup roller 300, is referred to as the "knock up" state. In the knock up state, the height of free end of the loading plate 200 may vary depending on the amount of the printing medium loaded on the loading plate 200.

The loading plate 200 further include a bearing roller supporting unit 220 protruding upwardly from a position at a side so as to not to interfere with the loading or picking up of the printing medium. A bearing roller 520 (shown in FIG. 2) is rotatably disposed supported by the bearing roller supporting unit 220.

When the cassette frame 100 is installed in the main body frame, the pickup roller 300 is disposed, e.g., in this embodiment, on the main body frame, at a position above the free end portion of the loading plate 200. When the loading plate 200 is in the knock up state, the pickup roller 300 picks up, and transports a printing medium from the top printing medium loaded on the loading plate 200. That is, the pickup roller 300 contacts and imparts frictional force to the printing medium positioned at the top of the stack loaded on the loading plate 200, the rotation of the pickup roller 300 picking up the printing medium.

The pickup roller 300 is coupled to a shaft 310 extending in parallel with the width of the loading plate 200. The shaft 310 is rotatably coupled to the main body frame. The pickup roller 300 and a cam member 510 are both coupled to the shaft 310. The various known mechanism may be employed for rotating the shaft 310. For example, a motor (not shown) and/or one or more driving force transmitting gear(s) (not shown) mounted to the main body frame may be employed.

A portion of the outer surface of the pickup roller 300 may be recessed toward the shaft 310 so that the recessed portion does not contact the printing medium even when the pickup roller 300 rotates during the knock up state. In addition, the pickup roller 300 further includes a pickup portion 320 that comes in contact with the printing medium during the knock up state.

In a standby state in which a printing operation is not performed, the loading plate 200 is moved away from the pickup roller 300 so that the pickup portion 320 is separated from the printing medium. This is referred to as the "knock down" state. If the printing operation is started, the pickup roller 300 rotates, and the pickup portion 320 approaches the printing medium. As the pickup portion 320 contacts the printing medium to pick up the printing medium by means of the rotation of the pickup roller 300 and the friction force between the printing medium and the pickup portion 320. To that end, the pickup portion 320 may be made of material having a high friction coefficient, such as, e.g., a rubber material.

An idle roller 400 may be provided at least on one side of the pickup roller 30 to also contact the printing medium, and may be mounted on the shaft 310 to idly rotate about the shaft 310. While it is not required, it is preferred that the diameter of the idle roller 400 is made slightly smaller than the diameter of the pickup roller 300 so that the pick up force from the pickup roller 300 may effectively be imparted on the printing medium.

The idle roller 400 slips against the shaft 310 when the shaft 310 rotates, and contacts with the printing medium to guide the printing medium to prevent the printing medium from being skewed.

The loading plate moving unit 500 causes the loading plate 200 to move between the knock up state and the knock down state.

When the printing operation starts, the loading plate 200 moves into the knock up state. Once the pickup roller 300 has picked up and thereby transported a printing medium, the loading plate moving unit 500 causes the loading plate 200 to move into the knock down state. In this manner, the loading plate 200 repeatedly moves up and down.

The loading plate moving unit 500 includes the cam member 510 coupled to the shaft 310 to rotate with the shaft 310 in a interlocked manner with the pickup roller 300, and to engage with the bearing roller 520 disposed on the loading plate 200 when the cam member 510 rotates during the knocked down state.

A flattened section 511 and prominence/depression sections 513 are formed on the outer surface of the cam member 510 contacting the bearing roller 520. When the cam member 510 rotates to begin engaging with the bearing roller 520, the flattened section 511 first comes into contact with the bearing roller 520, followed by the prominence and depression sections 513.

The flattened section 511 extends along the surface of the cam member 510 that contacts the bearing roller 520, and by engaging with the bearing roller 520 moves the loading plate 200 from the knock up state into the knock down state. When the loading plate transitions into the knocked down state from the knock up state, the flattened section 511 first comes into contact with and presses the bearing roller 520 to cause the loading plate 200 to be placed in the knocked down state. Subsequently, the prominence and depression sections 513 engages the bearing roller 520, causing the loading plate to vibrate up and down. That is, the loading plate 200 is first placed into the knock down state before the vibration is imparted to the loading plate 200.

The prominence and depression section 513 is formed to the outer surface of the cam member 510 from a position in which the flattened section 511 is ended. The prominence and depression section 513 is formed by the alternating concave portion and convex portions. The amount of the movement and the timing of the loading plate 200 depend on the interval between the depression portion and the prominence portion and the number of such portions, which may vary.

In the embodiment shown, the prominence and depression section 513 is shown to have a rounded ripple shape, which may allow easier movement of the loading plate 200. However, the shape of the prominence and depression section 513 may be any other shape that in engagement with the bearing roller 520 allows the movement of the loading plate 200.

While in this embodiment, the prominence and depression section 513 is provided to the cam member 510 mounted on the shaft 310, it should be readily apparent that the placement of the cam member 510 and the bearing roller 520 may be swapped. That is, the cam member 510 having the surface shape described above may be disposed on the loading plate 200 supported by the bearing roller supporting unit 220 while a roller or a portion of roller may be disposed on the shaft 310 to cooperate with the cam member 510 disposed on the loading plate so as to enable the movement of the loading plate as thus far described, and as further described below.

When the cam member 510 rotates, the loading plate 200 moves up and down while the bearing roller 520 contacts to the prominence and depression section 513. After the cam member 510 rotates into a position where the cam member 510 no longer engages the bearing roller 520, the loading plate 200 moves into the knock up state. That is the bearing roller 510 is released from the pressure from the cam member 510, which due to the upward bias imparted by the elastic member 210, the loading plate 200 moves upward so that the pickup roller 300 can pick up the printing medium.

Figure 3:
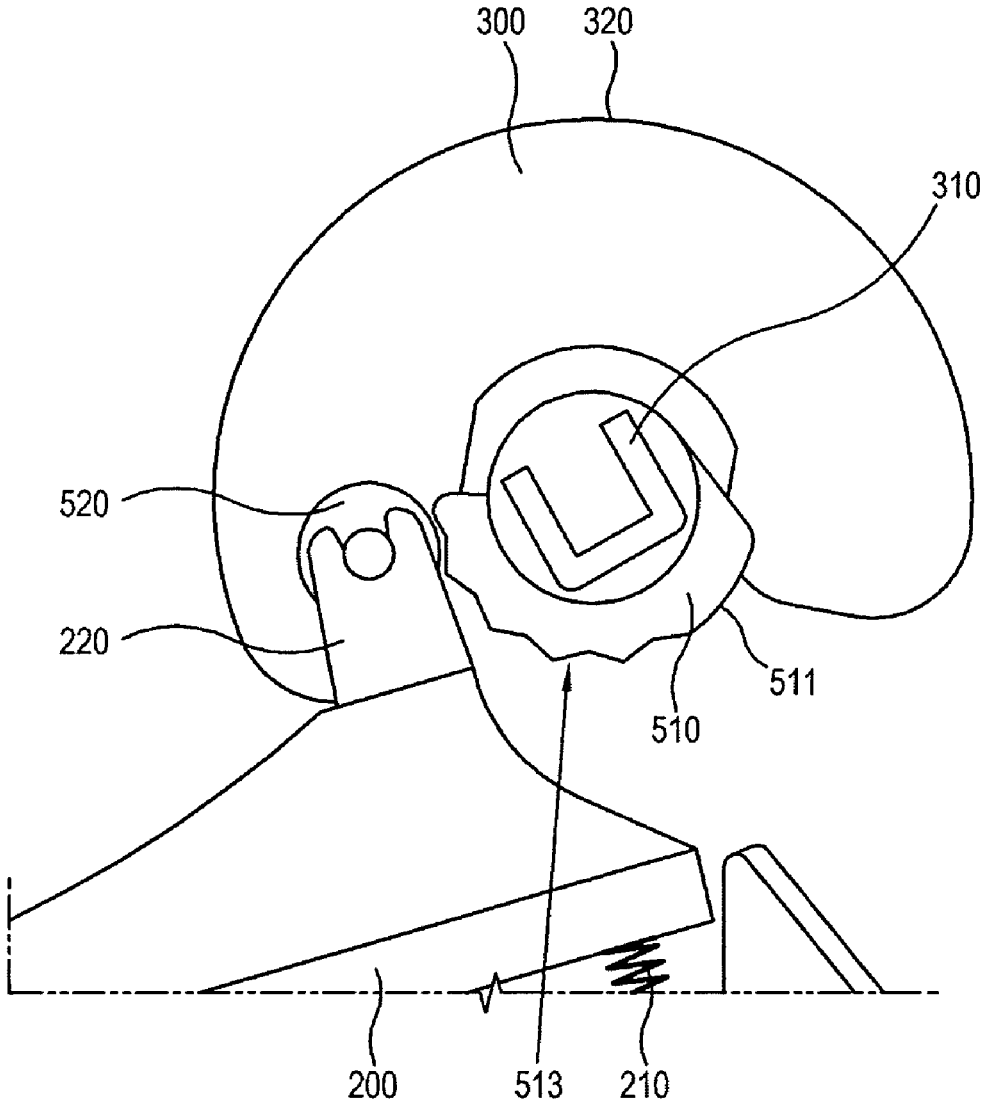
FIGS. 3 to 7 are side sectional views of the relevant portions of the medium supplying unit in FIG. 1 illustrating sequences of the operation of the loading plate moving unit.

FIG. 3 shows the relevant portions of the medium supplying unit in a standby state. As shown in FIG. 3, the pickup roller 300 has rotated into the position where the pickup portion 320 is placed away from the loading plate 200. Since the bearing roller 520 is not pressed by the cam member 510, the loading plate 200 is in the knock up state due to the bias from the elastic member 210.

Figure 4:
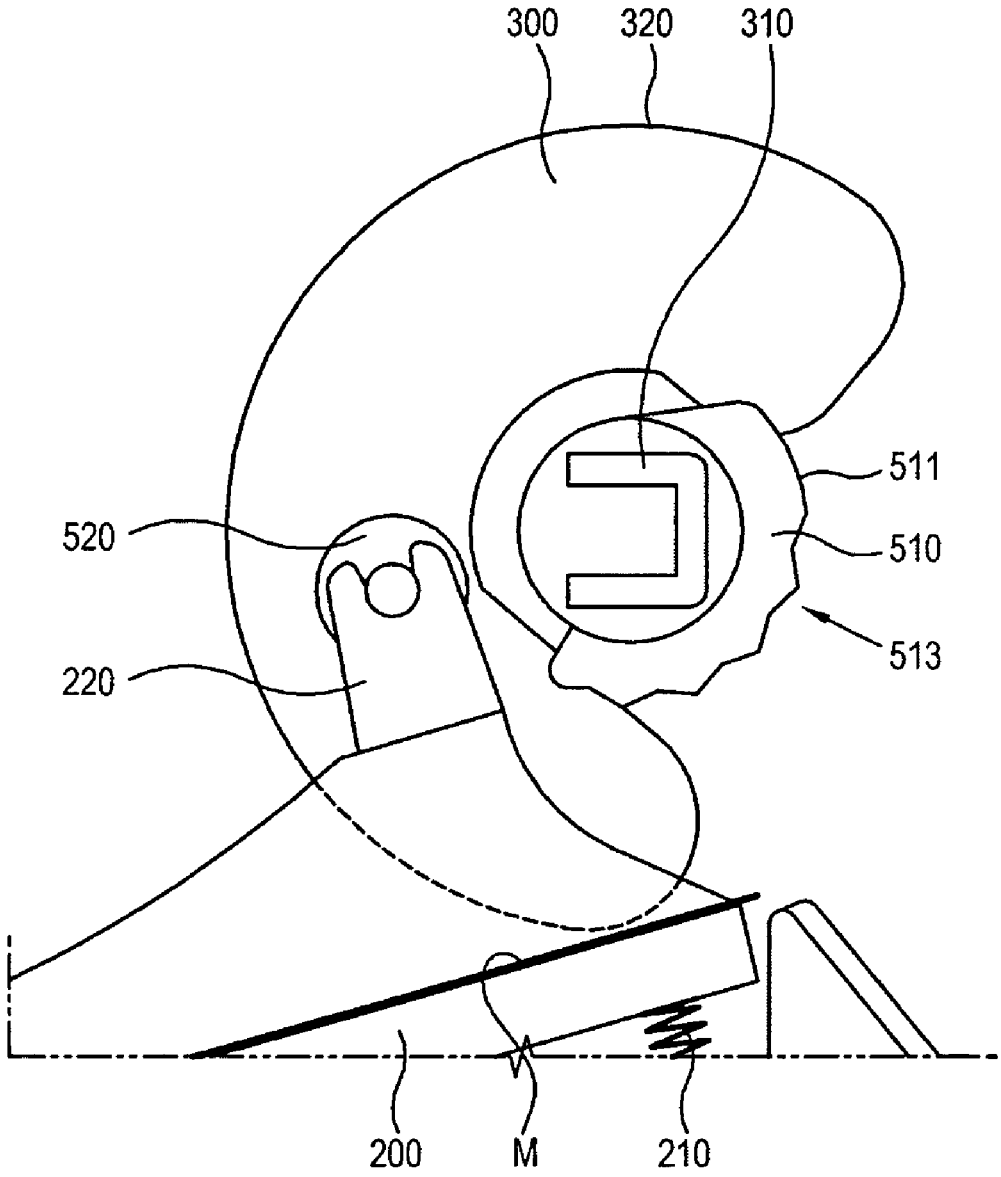

From the knock up state shown in FIG. 3, when a printing operation is started, the shaft 310 rotates, to which are coupled the pickup roller 300 and the cam member 510, which in turn rotate into the position shown in FIG. 4. The pickup portion 320 comes into a pressing contact with, and thus picks up, the printing medium M loaded on the loading plate 200, and the pickup roller 300 picks up the printing medium M. Since the cam member 510 does not yet engage the bearing roller 520, the loading plate 200 is maintained in the knock up state.

Figure 5:
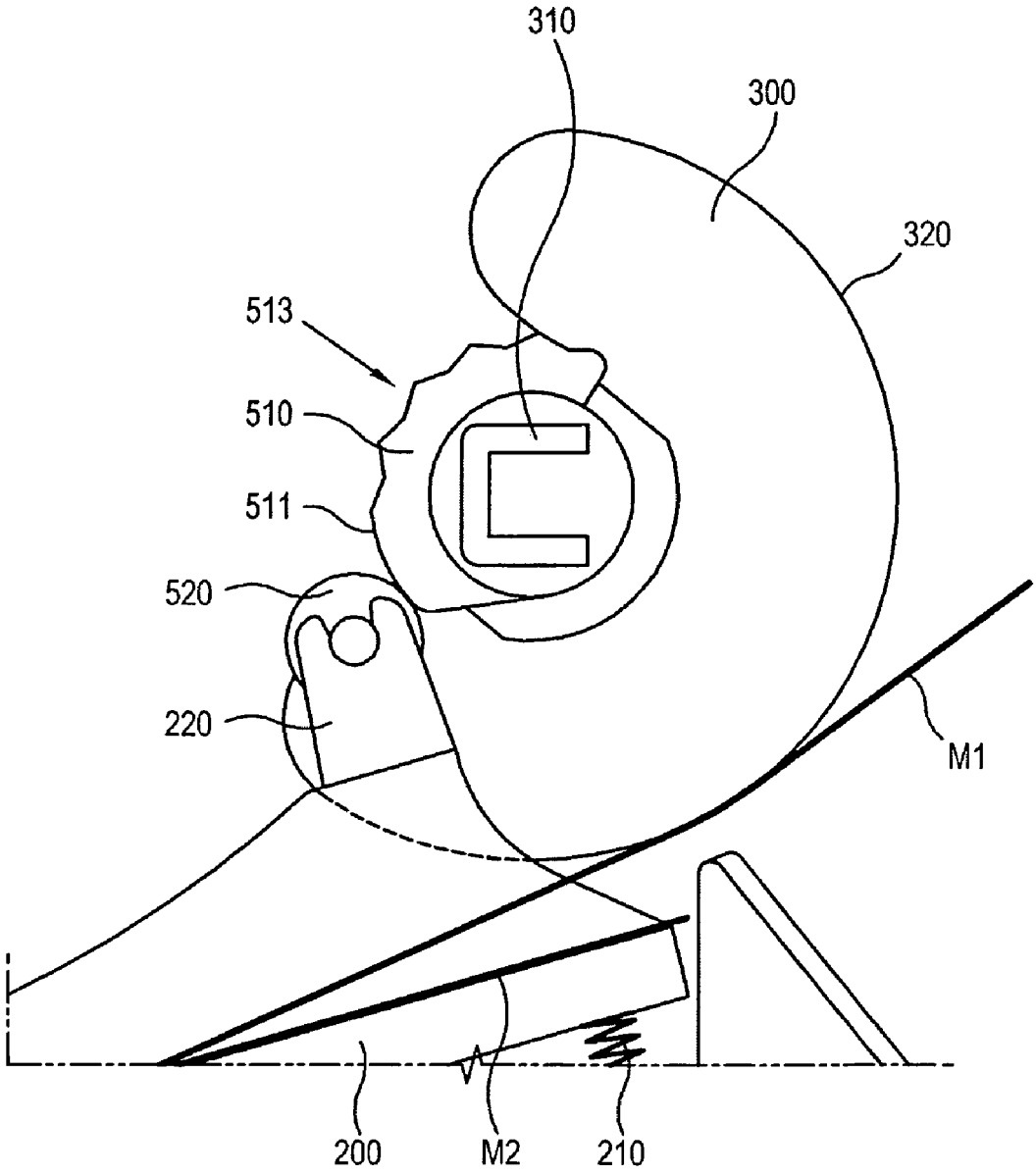

When the shaft 310 turns further so as to pick up and transfer the printing medium M1 as shown in FIG. 5, the cam member 510 also rotates so that the flattened section 511 of the cam member 510 starts to engage and press upon the bearing roller 520, and if the force from the cam member 510 overcomes the elastic force of the elastic member 210, the loading plate 200 moves downward, and becomes in the knock down state. In the knock down state, since the pickup roller 300 is separated from the loading plate 200, the printing medium M2 on the loading plate is not picked up, and thus is prevented from being carried together with the printing medium M1.

Figure 6:
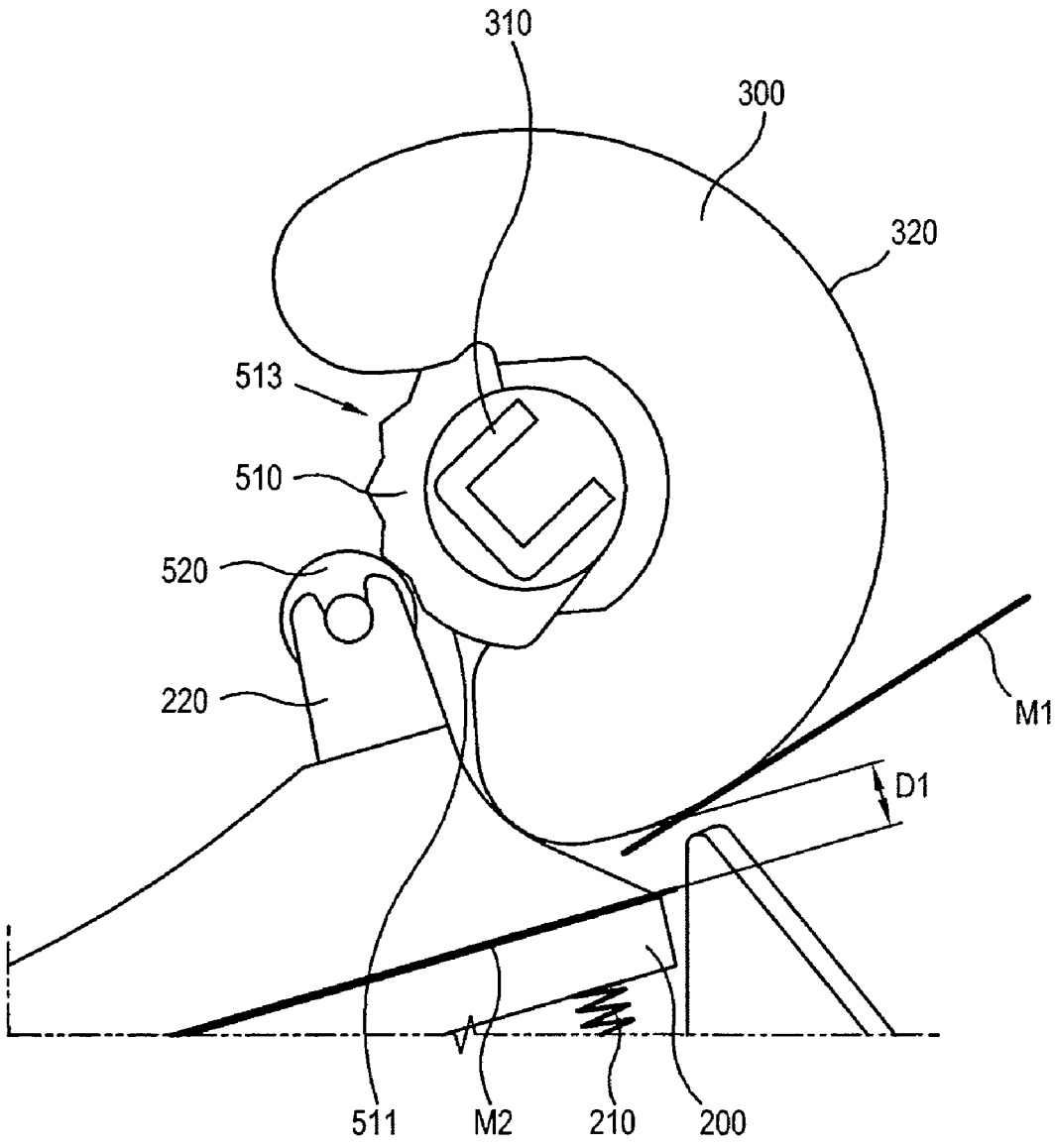
Figure 7:
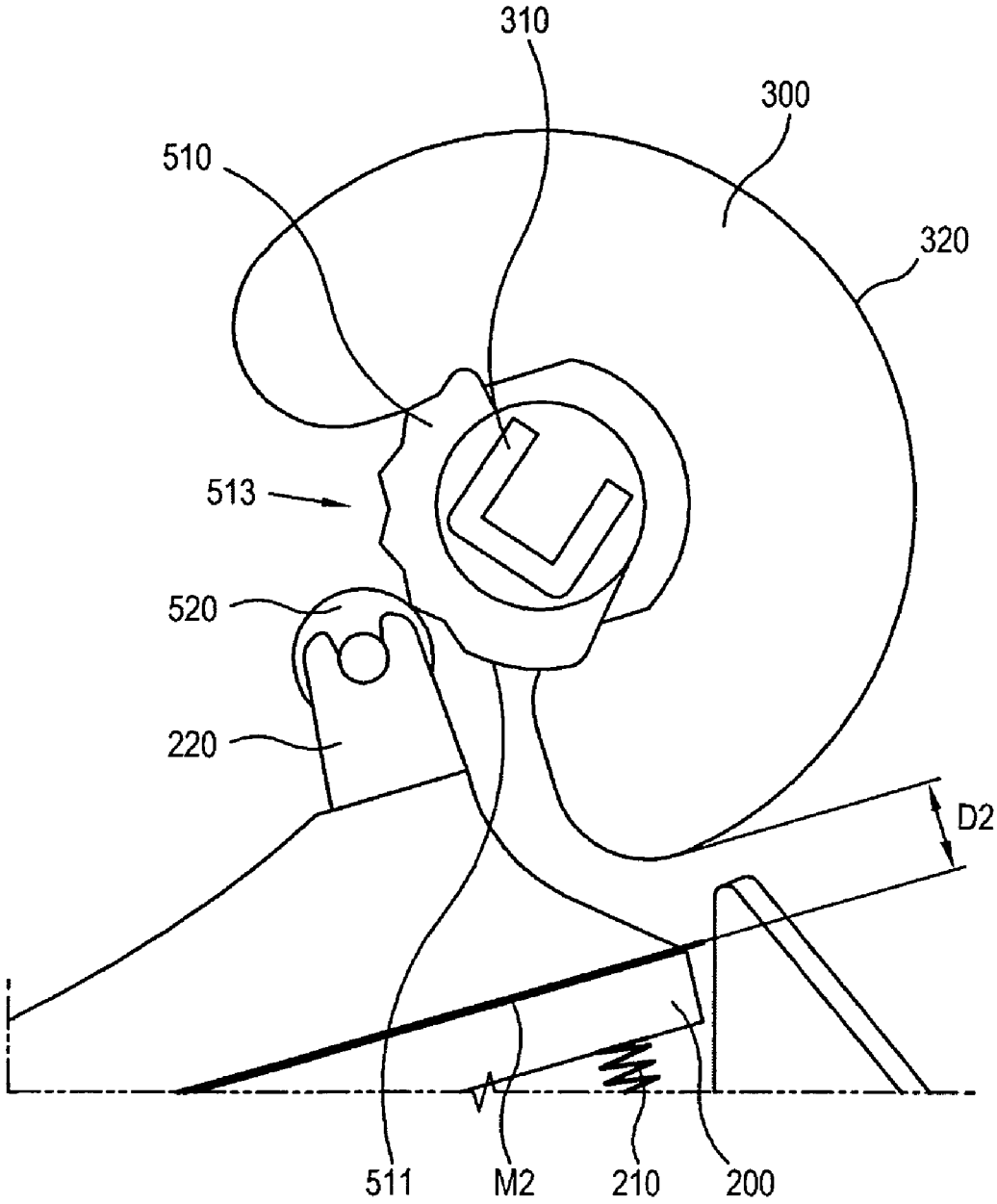

FIG. 6 is a sectional view illustrating the bearing roller 520 positioned in the depression portion of the prominence and depression section 513, and FIG. 7 is a sectional view illustrating the bearing roller 520 positioned in the prominence portion of the prominence and depression section 513.

As shown in FIGS. 6 and 7, as the cam member 510 rotates, the bearing roller 520 alternately contacts to the depression portion and the prominence portion of the prominence and depression section 513. Accordingly, the loading plate 200 can move up and down, and the resulting shaking or the vibration can be applied to the trailing end of the picked up printing medium M1, which prevents the leading edge of printing medium M2 from cling to the trailing end portion of the printing medium M1, thereby preventing the multi-sheet feeds.

D1 shown in FIG. 6 refers to the distance between the pickup roller 300 and the loading plate 200 when the bearing roller 520 is positioned in the depression portion of the prominence and depression section 513. D2 on the other hand refers to the distance between the pickup roller 300 and the loading plate 200 when the bearing roller 520 is positioned in the prominence portion of the prominence and depression section 513. The distance D1 is thus smaller than D2.

The loading plate 200 vibrates or is shaken due to the difference between the values of D1 and D2, the difference corresponding to the height difference between the depression portion and the prominence portion in the prominence and depression section 513.

In this manner, the bearing roller 520 sequentially contacts in alternating manner each of the prominence portions and the depression portions as the shaft 310 continues to rotate, the loading plate 200 moves up and down to prevent the multiple sheets being supplied. When the shaft 310 continues to rotate to the position where the cam member 510 does not contact the bearing roller 520, which is thus released from the downward pressure from the cam member 510, the loading plate 200 moves upward due to the elastic bias from the elastic member 210 into the knock up state (shown in FIG. 3), and the next printing medium, i.e., M2, is allowed to be picked up by the pickup roller 300 for the next printing operation.

As describe above, the loading plate 200 is made to move from the knock up state into the knock down state by means of the cam member 510, and the loading plate 200 in the knock down state is repeatedly moved up and down. Accordingly, during when the printing medium M1 is being picked up, the other printing media from the loading plate 200, e.g., M2 can be prevented from clinging to M1, and thus also being supplied.

Figure 8:
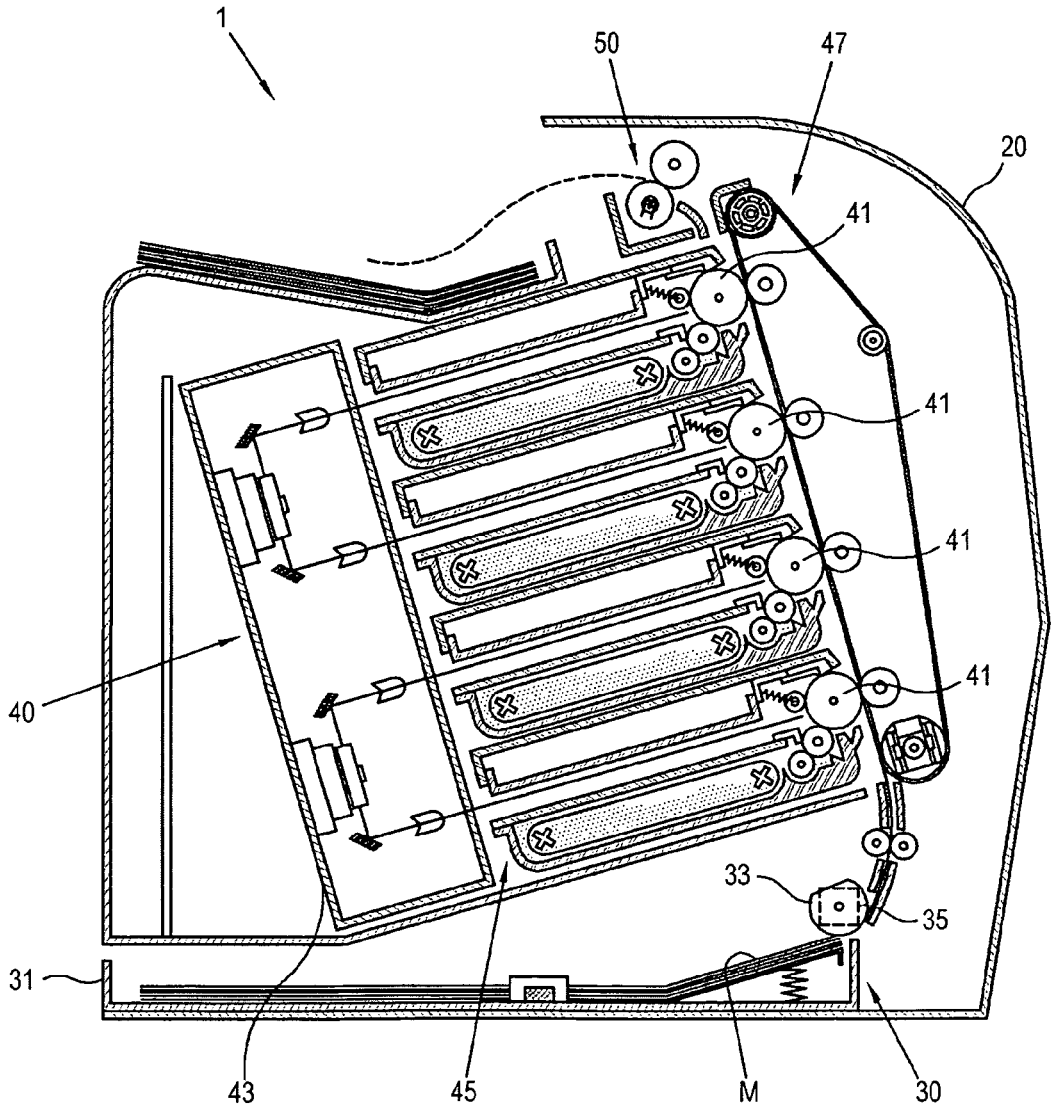
FIG. 8 is a sectional view of an image forming apparatus according to an embodiment of the present invention.

FIG. 8 is a side sectional view showing the relevant portions of an image forming apparatus 1 according to an embodiment of the present invention. As shown therein, the image forming apparatus 1 according the present embodiment may include a main frame 20, a medium supplying unit 30, which holds and supplies the printing medium M, and an image forming unit 40 forming an image on the printing medium M supplied from the medium supplying unit 30.

The image forming unit 40 includes a plurality of image carrying bodies 41 for forming an electrostatic latent image, which is developed into a visible image by means of a developer, a light scanning unit 43 forming the electrostatic latent image on the image carrying body 41, a developing unit 45 supplying the developer to the image carrying body 41, and a transferring unit 47 transferring the visible image of the image carrying body 41 to the printing medium M. A fusing unit 50 applies heat and/or pressure to the printing medium M to which the visible image is transferred to fuse the visible image on the printing medium M.

It should be readily apparent that the configuration of the image forming unit 40 is not limited to the embodiment shown in FIG. 8, and can be various other configurations for forming an image on the printing medium M. For example, the image forming unit 40 may jet an ink on the printing medium M to form the image thereon.

The medium supplying unit 30 is loaded with the printing medium M, and supplies the loaded printing medium M to the image forming unit 40 an individual sheet at a time. A cassette frame 31 loaded with the printing medium M is detachably mounted to the main body frame 20 so that a user can load the printing medium M to the medium supplying unit 30. The medium supplying unit 30 may further include a pickup roller 33 and a loading plate moving unit 35. The medium supplying unit 30 may have the substantially same configuration as the medium supplying unit 10 describe above.

A plurality of image carrying bodies 41, for example in this color image forming apparatus example, four bodies corresponding to yellow, magenta, cyan and black are disposed in sequence along the transportation path of the printing medium M to form a color image on the printing medium M. After the image carrying surface of the image carrying body 41 is uniformly charged, an electrical potential difference is generated when the surface is irradiated with a light beam supplied from the light scanning unit 43, the potential difference defining the electrostatic latent image. If the developer is supplied from the developing unit 45 to the electrostatic latent image on the image carrying body 41, a visible image is formed on the surface of the image carrying body 41.

The light scanning unit 43 emits the beam to each image carrying body 41 to form the electrostatic latent image, each of the light beam corresponding to one of the four colors resulting in the electrostatic latent image on each image carrying body 41 representing the portion of the image in the corresponding color.

The developing unit 45 is provided to supply the corresponding color developer to the image carrying bodies 41, resulting in visible images having different colors being formed on the respective image carrying bodies 41.

The transferring unit 47 transports the printing medium M to pass through the plurality of image carrying bodies 41 in sequence so that visible images of the respective image carrying bodies 41 can be transferred in overlapping manner on the printing medium.

The loading plate is caused to be moved in reciprocating manner during the picking up of a printing medium, resulting in a vibration being imparted to the trailing edge portion of the printing medium being picked up, thereby preventing additional sheets of printing media being clung or adhered to the printing medium being picked up. The vibration reduces the occurrence of concurrent supply of multiple sheets of printing media.

To that end, a cam member formed with a prominence and depression section may be employed, the prominence and depression section being in pressing contact with a portion of the loading plate as the cam member rotates, thereby enabling the loading plate to move in association with the contour of the prominence and depression section of the cam member. A plurality of prominence portions and depression portions may be provided to enable a repeated motion of the loading plate.

A bearing roller may be provided in the loading plate to rotate in cooperation with the prominence and depression unit to enhance the movement of the loading plate.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A printing medium supplying unit of an image forming apparatus, comprising:

a medium supplying unit frame;

a loading plate movably coupled to the medium supplying unit frame, the loading plate including a surface for supporting a plurality of printing media thereon, the loading plate being movable between a knock up state and a knock down state a pickup roller disposed at a location in relation to the loading plate such that, when the loading plate is in the knock up state, the pick up roller is capable of contacting at least one of the plurality of printing media supported on the surface of the loading plate to pick up the at least one of the plurality of printing media, and, when the loading plate is in the knock down state, the pickup roller is spaced apart from the plurality of printing media, the loading plate being positioned in a knock up state such that the pickup roller allows to contact and to pick up at least one of the plurality of printing media supported on the surface of the loading plate, or the loading plate being positioned in a knock down state such that the pickup roller is spaced apart from the plurality of printing media; and a loading plate moving unit having a cam formed with a plurality of prominence portions and a plurality of depressed portions to repeatedly move the loading plate in opposite directions when the loading plate is in the knock down state and arranged to rotate in interlocked manner with the pickup roller, the loading plate moving unit being configured to cooperate with a portion of the loading plate to impart movements of the loading plate in opposite directions when the loading plate is in the knock down state.

2. The printing medium supplying unit according to claim 1, wherein the cam member is coupled to a shaft, to which the pickup roller is coupled, so that the cam member and the pickup roller being rotatable about an axis along the shaft, the cam member including a contact portion that is capable of being in pressing contact with the portion of the loading plate.

3. The printing medium supplying unit according to claim 2, wherein the contact portion of the cam member comprises a prominence and depression section that includes at least one prominence portion configured to cooperate with the portion of the loading plate so that the loading plate is spaced apart from the shaft by a first distance, the prominence and depression section further including at least one depression portion configured to cooperate with the portion of the loading plate so that the loading plate is spaced apart from the shaft by a second distance, the movement of the loading plate corresponding to a difference between the first distance and the second distance.

4. The printing medium supplying unit according to claim 3, wherein the at least one prominence portion comprises the plurality of prominence portions, the at least one depression portion comprises the plurality of depression portions, the plurality of prominence portions and the plurality of depression portions disposed in alternating manner with respect to each other, the portion of the loading plate being in contact sequentially with the plurality of prominence portions and the plurality of depression portions so that the movement of the loading plate occurs repeatedly.

5. The printing medium supplying unit according to claim 3, wherein the cam member further comprises a flattened section arranged to come in pressing contact with the portion of the loading plate prior to the portion of loading plate coming in contact with the prominence and depression section to thereby placing the loading plate in the knock down state before the prominence and depression section imparts the movement of the loading plate.

6. The printing medium supplying unit according to claim 5, wherein the portion of the loading plate comprises a bearing roller disposed on the loading plate to contact with the cam member.

7. An image forming apparatus, comprising:

a main body frame defining an outer appearance of the image forming apparatus;

an image forming unit which forms an image on a printing medium; and a printing medium supplying unit frame for supplying the printing medium to the image forming unit, the printing medium supplying unit comprising:

a loading plate movably coupled to the medium supplying unit frame, the loading plate including a surface for supporting a plurality of printing media thereon, the loading plate being movable between a knock up state and a knock down state;

a pickup roller disposed at a location in relation to the loading plate such that, when the loading plate is in the knock up state, the pick up roller is capable of contacting at least one of the plurality of printing media supported on the surface of the loading plate to pick up the at least one of the plurality of printing media, and, when the loading plate is in the knock down state, the pickup roller is spaced apart from the plurality of printing media, the loading plate being positioned in a knock up state such that the pickup roller allows to contact and to pick up at least one of the plurality of printing media supported on the surface of the loading plate, or the loading plate being positioned in a knock down state such that the pickup roller is spaced apart from the plurality of printing media; and a loading plate moving unit having a cam formed with a plurality of prominence portions and a plurality of depressed portions to repeatedly move the loading plate in opposite directions when the loading plate is in the knock down state and arranged to rotate in interlocked manner with the pickup roller, the loading plate moving unit being configured to cooperate with a portion of the loading plate to impart movements of the loading plate in opposite directions when the loading plate is in the knock down state.

8. The image forming apparatus according to claim 7, wherein the loading plate moving unit comprises a shaft rotatably coupled to the main body frame, the cam member coupled to the shaft, to which the pickup roller is coupled, so that the cam member and the pickup roller being rotatable about an axis extending along the shaft, the cam member including a contact portion that is capable of being in pressing contact with the portion of the loading plate.

9. The image forming apparatus according to claim 8, wherein the contact portion of the cam member comprises a prominence and depression section that includes at least one prominence portion configured to cooperate with the portion of the loading plate so that the loading plate is spaced apart from the shaft by a first distance, the prominence and depression section further including at least one depression portion configured to cooperate with the portion of the loading plate so that the loading plate is spaced apart from the shaft by a second distance, the movement of the loading plate corresponding to a difference between the first distance and the second distance.

10. The image forming apparatus according to claim 9, wherein the at least one prominence portion comprises the plurality of prominence portions, the at least one depression portion comprises the plurality of depression portions, the plurality of prominence portions and the plurality of depression portions disposed in alternating manner with respect to each other, the portion of the loading plate being in contact sequentially with the plurality of prominence portions and the plurality of depression portions so that the movement of the loading plate occurs repeatedly.

11. The image forming apparatus according to claim 9, wherein the cam member further comprises a flattened section arranged to come in pressing contact with the portion of the loading plate prior to the portion of loading plate comes in contact with the prominence and depression section to thereby placing the loading plate in the knock down state before the prominence and depression section imparts the movement of the loading plate.

12. The image forming apparatus according to claim 11, wherein the portion of the loading plate comprises a bearing roller disposed on the loading plate to contact with the cam member.

13. The image fanning apparatus according to claim 7, further comprising:

a medium supplying unit frame removably received in the main body frame, wherein the loading plate being movably coupled to the medium supplying unit frame.

14. The image forming apparatus according to claim 7, wherein:

the image forming unit is configured to jet ink on the printing medium.

15. A printing medium supplying unit of an image forming apparatus, comprising:

a medium supplying unit frame;

a loading plate movably coupled to the medium supplying unit frame, the loading plate including a surface for supporting a plurality of printing media thereon, the loading plate being positioned in a knock up state so that a pick up roller of the image forming apparatus allows to contact and to pick up at least one of the plurality of printing media supported on the surface of the loading plate, or the loading plate being positioned in a knock down state so that the pickup roller is spaced apart from the plurality of printing media; and a loading plate moving unit having a cam formed with a plurality of prominence portions and a plurality of depressed portions to repeatedly move the loading plate in opposite directions when the loading plate is in the knock down state and configured to impart movements of the loading plate in opposite directions when the loading plate is in the knock down state.

16. The printing medium supplying unit according to claim 15, wherein the cam member is coupled to a shaft of the pickup roller, the cam member including a contact portion that is capable of being in pressing contact with a bearing roller disposed on the loading plate.

17. The printing medium supplying unit according to claim 16, wherein the contact portion of the cam member comprises a prominence and depression section that includes at least one prominence portion configured to cooperate with the bearing roller so that the loading plate is spaced apart from the shaft by a first distance, the prominence and depression section further including at least one depression portion configured to cooperate with the bearing roller so that the loading plate is spaced apart from the shaft by a second distance, the movement of the loading plate corresponding to a difference between the first distance and the second distance.

18. The printing medium supplying unit according to claim 17, wherein the at least one prominence portion comprises the plurality of prominence portions, the at least one depression portion comprises the plurality of depression portions, the plurality of prominence portions and the plurality of depression portions disposed in alternating manner with respect to each other, the bearing roller being in contact sequentially with the plurality of prominence portions and the plurality of depression portions so that the movement of the loading plate occurs repeatedly.

19. The printing medium supplying unit according to claim 17, wherein the cam member further comprises a flattened section arranged to come in pressing contact with the bearing roller prior to the bearing roller coming in contact with the prominence and depression section to thereby placing the loading plate in the knock down state before the prominence and depression section imparts the movement of the loading plate.

20. The printing medium supplying unit according to claim 15, further comprising:

an elastic member disposed between the medium supplying unit frame and the loading plate, the elastic member imparting an elastic bias on the loading plate so that the loading plate is biased to be in the knock up state.

21. A printing medium supplying unit of an image forming apparatus, comprising:

a medium supplying unit frame;

a loading plate movably coupled to the medium supplying unit frame, the loading plate including a surface for supporting a plurality of printing media thereon, the loading plate being positioned in a knock up state so that a pick up roller of the image forming apparatus allows to contact and to pick up at least one of the plurality of printing media supported on the surface of the loading plate, or the loading plate being positioned in a knock down state so that the pickup roller is spaced apart from the plurality of printing media; and a loading plate moving unit having a cam formed with a plurality of prominence portions and a plurality of depressed portions to repeatedly move the loading plate in opposite directions when the loading plate is in the knock down state.

22. The printing medium supplying unit of claim 21, wherein the prominence portions and the depressed portions are alternately formed on the cam of the loading plate moving unit.

* * * * *